United States Patent [19]

Sawyer

[11] 4,173,865

[45] Nov. 13, 1979

[54] AUXILIARY COIL ARRANGEMENT

[75] Inventor: George N. Sawyer, Flint, Tex.

[73] Assignee: General Electric Company, Louisville, Ky.

[21] Appl. No.: 899,777

[22] Filed: Apr. 25, 1978

[51] Int. Cl.[2] ..... F25B 13/00

[52] U.S. Cl. ..... 62/324; 62/160

[58] Field of Search ..... 62/324 A, 324 D, 198, 62/117, 160; 237/2 B

[56] References Cited

U.S. PATENT DOCUMENTS

| | | | |
|---|---|---|---|
| 2,474,304 | 6/1949 | Clancy | 62/140 |
| 2,720,756 | 10/1955 | Stebbins | 62/160 |
| 2,746,266 | 5/1956 | Kosfeld | 62/324 |
| 2,801,528 | 8/1957 | Parcaro | 62/324 X |
| 2,934,323 | 4/1960 | Burke | 62/324 X |
| 2,959,933 | 11/1960 | Burke | 62/183 |
| 2,976,696 | 3/1961 | Rhea et al. | 62/115 |
| 3,024,619 | 3/1962 | Gerteis et al. | 62/160 |
| 3,029,614 | 4/1962 | Smith et al. | 62/324 |
| 3,110,162 | 11/1963 | Gerteis | 62/196 |
| 3,150,501 | 9/1964 | Moore | 62/174 |
| 3,358,469 | 12/1967 | Quick | 62/196 |
| 4,030,315 | 6/1977 | Harnish | 62/324 |

*Primary Examiner*—William F. O'Dea
*Assistant Examiner*—William E. Tapolcai, Jr.
*Attorney, Agent, or Firm*—Frank P. Giacalone; Radford M. Reams

[57] ABSTRACT

A reversible cycle heat pump refrigeration system having an outdoor heat exchanger coil and an indoor heat exchanger coil, and including an auxiliary coil arrangement located in the system so as to increase the heat pump capacity of the system. The auxiliary coil arrangement is associated with, and in air flow arrangement with, at least one of the heat exchangers. The auxiliary coil is connected in parallel refrigerant flow arrangement with the expansion device so that when the associated heat exchanger functions as the system evaporator liquid refrigerant by-passes the auxiliary coil, and when the associated heat exchanger functions as a condenser the auxiliary coil functions as a subcooling coil.

13 Claims, 3 Drawing Figures

AUXILIARY COIL ARRANGEMENT

BACKGROUND OF THE INVENTION

As is well known in the air conditioning art, and more particularly those employing hermetic refrigeration systems, maximum efficiency of an evaporator is attained by maintaining the refrigerant stream leaving the evaporator in a saturated gaseous state so that the entire heat transfer surface of the evaporator is subjected to heat absorption by vaporization. With this ideal condition, the refrigerant absorbs latent heat in the evaporator and no sensible heat to raise its temperature following vaporization with the result that the maximum available refrigerating effect is attained. It has been general practice in the refrigeration industry to size evaporator coils with an amount of surface and pressure drop to assure that the refrigerant leaving the evaporator is in an expanded and superheated gaseous state.

The condenser, on the other hand, is designed to provide totally liquid phase refrigerant to the expansion or capillary valve, which as is well known cannot tolerate any significant amount of refrigerant gas. Consequently, the refrigerant must be totally condensed to a liquid phase in the condenser.

Conventional heat pump refrigeration systems of the type to which this invention particularly relates comprise indoor and outdoor coils or heat exchangers connected to a closed refrigerant circuit. Refrigerant is circulated through the coils by a compressor which pumps the compressed refrigerant gas through the coil where it is condensed and passes through a means for expansion, such as a capillary tube or expansion valve, to the other coil for evaporation. The system includes suitable change-over valve mechanisms for reversing the function of the indoor and outdoor heat exchangers permitting the indoor exchanger to function as an evaporator for summertime cooling or as a condenser for wintertime heating, the other coil performing the opposite function.

One of the shortcomings of the prior art heat pump refrigeration systems of the type described above is their incapability of the heat exchangers to operate efficiently both as evaporators and condensers. This is especially true since it takes a greater pressure drop through the condenser to change the high pressure gas to a high pressure liquid than it does for the evaporator to change low pressure liquid to a low pressure gas. Accordingly, in heat pump or reverse cycle refrigeration systems when the coils designed to operate as evaporators and condensers are reversed in the refrigeration cycle, they are inefficient.

In other prior cooling systems an auxiliary coil has been used to increase the subcooling of the condensed refrigerant, usually in conjunction with a liquid receiver. In this arrangement all of the condensing coil can be used to condense high pressure gas to a liquid. The receiver collects the extra liquid so it does not back up into the condenser using up condensing surface. The liquid then feeds from the receiver to the specialized subcooling coil where it is further cooled to provide added capacity to the system. This system does not function well in reverse, as an evaporator, because of the excessive pressure drop of evaporating refrigerant passing through the subcooling coil.

In still other prior art arrangements such as 3,024,619-Gerteis, for application in a heat pump the auxiliary coil is alternately connected to the main heat exchanger as a subcooling coil when the heat exchanger is condensing and integrated as part of the evaporator when the heat exchanger functions as an evaporator.

SUMMARY OF THE INVENTION

A heat pump system including an indoor and outdoor heat exchanger, an expansion device associated with each of the heat exchangers for regulating refrigerant flow. A reversing arrangement for conducting refrigerant flow in a cooling mode from the compressor to the outdoor heat exchanger through the indoor heat exchanger and its associated expansion device and back to the compressor, and for reversing the refrigerant flow in a heating mode.

An auxiliary coil including a valve is arranged in the path of air passing over at least one heat exchanger. The auxiliary coil and valve is located in parallel refrigerant flow relative to the heat exchanger expansion device. The valve is responsive to direction of refrigerant flow only in one direction so that when the heat exchanger functions as a condenser the valve allows refrigerant to flow through the auxiliary coil causing it to operate as a subcooling coil. When the heat exchanger functions as an evaporator the valve prevents refrigerant from leaving the auxiliary coil or to flow therethrough and accordingly the refrigerant may be stored therein.

DESCRIPTION OF THE PREFERRED EMBODIMENT

Figure 1:
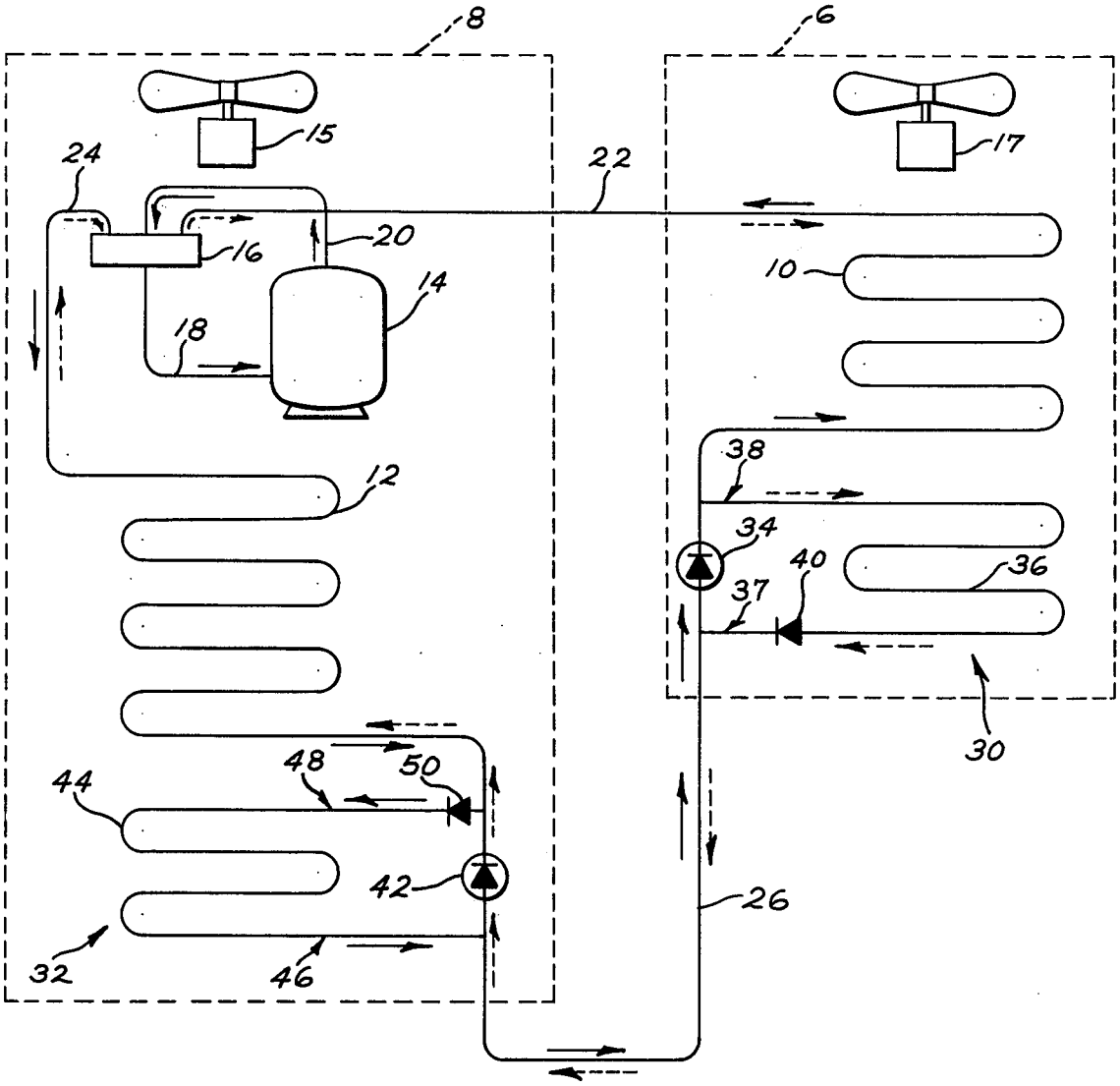
FIG. 1 is a schematic diagram of one embodiment of a heat pump with the auxiliary coil arrangement of this invention applied to both the indoor and outdoor heat exchangers.

Referring now to the drawing, and more particularly to FIG. 1, the heat pump with which the present invention is applied to or used, is a closed circuit, reversible mechanical refrigeration system, including an indoor heat exchanger or coil 10, an outdoor heat exchanger or coil 12, a compressor 14 and a reversing valve 16. The compressor is supplied with low pressure refrigerant through a suction conduit 18 and delivers high pressure refrigerant through a discharge conduit 20. A conduit 22 extends between the indoor heat exchanger 10 and the reversing valve 16, while a conduit 24 extends between the reversing valve 16 and the outdoor heat exchanger 12. As will be understood by those familiar in the art, in a split system generally the outdoor heat exchanger 12, compressor 14, the fan 15 for moving air through heat exchanger 12, and their associated components are arranged in an outdoor unit designated 18, while the indoor coil 10, the fan 17 for moving air through heat exchanger 10, and their associated parts are arranged in an indoor unit 6 which is generally located within the enclosure to be conditioned.

In the operation of the heat pump, when the reversing valve 16 is positioned in the cooling cycle or mode, the direction of refrigerant flow is indicated by the solid line arrows along the tubing. The refrigerant is compressed in the compressor 14, pumped through discharge conduit 20, reversing valve 16, conduit 24, to the outdoor heat exchanger 12 wherein the refrigerant is condensed to liquid, passed through a liquid line conduit 26, an indoor restriction or expansion device 34, and expanded into the indoor heat exchanger 10 to cool the enclosure in which the indoor unit 6 is located and then returned to the compressor 14 through line 22, reversing valve 16 and suction conduit 18. During the heating cycle, this procedure is reversed so that the compressed refrigerant flow in the direction indicated by the broken line arrows is delivered through discharge conduit 20, reversing valve 16, conduit 22, to the indoor heat exchanger 10 wherein it condenses and gives up heat, passes through a liquid line conduit 26, through the outdoor restriction or expansion device 42 into the outdoor heat exchanger 12 wherein it takes on heat by evaporation and returned to the compressor 14. The system thus far described is conventional, and as such, by itself, forms no part of the present invention.

It should be noted that the pressure drop through a heat exchanger operating as a condenser in a refrigeration system is generally more than that required for the heat exchanger operating as an evaporator. Accordingly, when a heat exchanger that was designed to function as the system evaporator is called upon to function as the system condenser poor subcooling of liquid refrigerant results. Further, the pressure drop through a heat exchange operating as an evaporator in a refrigeration system is generally less than that required of the heat exchanger operating as a condenser. When a heat exchanger that was designed to function as the system condenser is called upon to function as the system evaporator the pressure drop may be sufficient to degrade the evaporating performance of the heat exchanger.

Accordingly, by the present invention, there is provided means for permitting the heat exchanger to efficiently function alternatively as the system condenser and evaporator in the heating and cooling cycle. To this end an auxiliary coil arrangement is provided by the present invention which is generally positioned in the air flow upstream from the heat exchanger.

Referring to FIG. 1 there is shown an auxiliary coil arrangement 30 and 32 as applied to both the indoor and outdoor heat exchangers 10 and 12 respectively. With reference to the indoor unit 6, the indoor expansion device or valve 34 is arranged in flow relationship between liquid line 26 and the heat exchanger 10. The indoor expansion valve 34 is responsive to directional flow of refrigerant and permits a regulated flow of refrigerant toward the heat exchanger 10 from liquid line 26 only in the cooling cycle as indicated by the solid line arrows. In the reverse flow or heating cycle, refrigerant flow is blocked by the expansion valve 34 and flow is regulated by the outdoor expansion valve 42, as will be explained hereinafter. The auxiliary coil arrangement in the indoor section 6 includes a subcooling coil 36 that is connected by flow conduits 37, 38 and in parallel flow with the expansion valve 34. In the present instance the auxiliary coil arrangement 30 is positioned upstream in the air flow passing through the heat exchanger 10 under influence of fan 17. Arranged in the flow conduit 37 is an indoor check valve 40 that is responsive to directional flow of refrigerant and permits refrigerant flow through the coil 36 only in the heating cycle as indicated by the broken line arrows when indoor heat exchanger 10 is functioning as the system condenser. In the reverse or cooling cycle refrigerant from the liquid line 26 is blocked from entering the coil 36 by check valve 40 while flow as mentioned above is permitted through expansion valve 34 and heat exchanger 10 which is functioning as the system evaporator.

With reference to the outdoor unit 8, the outdoor expansion device or valve 42 is arranged in refrigerant flow relationship between liquid line 26 and the heat exchanger 12. The outdoor expansion valve 42 is responsive to direction flow of refrigerant and permits a regulated flow of refrigerant toward the heat exchanger 12 from liquid line 26 only in the heating cycle as indicated in broken line arrows. In the reverse flow or cooling cycle, refrigerant flow is blocked by the expansion valve 42 and flow is regulated by the indoor expansion valve 34. The auxiliary coil arrangement in the outdoor section 8 includes a subcooling coil 44 that is connected by flow conduits 46, 48 in parallel flow with the expansion valve 42. The auxiliary coil arrangement 32 is positioned upstream in the air flow passing through the heat exchanger 12 under influence of fan 15. Arranged in the flow conduit 48 is an outdoor check valve 50 that is responsive to directional flow of refrigerant and permits refrigerant flow through the coil 44 only in the cooling cycle as indicated by the solid line arrows when the outdoor heat exchanger is functioning as the system condenser. In the reverse or heating cycle refrigerant from the liquid line 26 is permitted to flow through expansion valve 42 and outdoor heat exchanger 12 which is functioning as the system evaporator. At the same time, a portion of refrigerant from the liquid line 26 enters subcooling coil 44 and is blocked from flowing therethrough by action of the check valve 50.

In operation during the cooling cycle hot gas enters the outdoor heat exchanger 12 functioning as the system condenser, through conduit 24, and is condensed to a liquid. Since passage through expansion valve 42 is blocked in this flow direction the condensed liquid refrigerant must pass through check valve 50 and subcooling coil 44, as indicated by the solid line arrows, and into the liquid line 26.

From liquid line 26 refrigerant flows through the indoor expansion valve 34, heat exchanger 10 functioning as the evaporator. In the cooling cycle, the subcooling coil 36 is not in the active refrigerant circuit since the flow is blocked by the check valve 40 so that a relatively low pressure drop is experienced across the system evaporator, now heat exchanger 10. The subcooling coil 36 is further kept empty of liquid refrigerant by the location of the check valve 40 in conduit 37 at the high pressure end with the other or open end connected to line 38 to low pressure.

In the heating operation, hot gas enters heat exchanger 10 functioning as the system condenser through conduit 22 and is condensed to a liquid. Passage through expansion valve 34 is blocked and the condensed liquid refrigerant must pass through the subcooling coil 36 and check valve 40 and into the liquid line 26.

From liquid line 26 liquid refrigerant flows through the outdoor expansion valve 42, heat exchanger 12 functioning as the system evaporator. At the same time, a portion of liquid refrigerant fills up the auxiliary coil 44, but cannot flow through because of the action of check valve 50 and is in effect stored during the heating cycle.

The advantage of the auxiliary coil arrangement 30 as applied to the indoor heat exchanger 10 is that it provides good condensing and subcooling performance in the heating mode with heat exchanger 10 functioning as the system condenser, while providing an evaporator in the cooling mode when heat exchanger 10 is functioning as an evaporator that has a low pressure drop and efficient performance. Another advantage in the arrangement of auxiliary coil 30 is realized in the cooling mode is due to the location of check valve 40 in that the subcooling coil 36 is not in the active circuit and does not condense liquid on its surface as does the evaporator and accordingly it does not have to be arranged over a drip pan or include means for disposing of condensate.

The advantage of the auxiliary coil arrangement 32 relative to the outdoor heat exchanger 12 is that the heat exchanger 12 can have the required low pressure drop and efficient performance when it is functioning as the system evaporator in the heating mode, while the combination of heat exchanger 12 and coil 44 in series flow in the cooling cycle will provide the required subcooling when the heat exchanger 12 is functioning as the system condenser. Another function of the present arrangement is that coil 44 acts as a modulator in the heating cycle by removing an amount of liquid refrigerant from the active circulation in the system. This is possible because of the location of check valve 50 in conduit 48 in the low pressure end of the coil 44, while the opposite end at conduit 46 is connected to the high pressure liquid line end.

It should be understood that the auxiliary coil arrangements 30 and 32 of the present invention are not necessarily part of the heat exchanger in which they are functionally applied and accordingly they may be of a different design and located separately from their associated heat exchangers. The present design allows the auxiliary coil arrangement comprising the subcooling coil and its associated check valve to be added to existing heat pumps. For example, the indoor auxiliary coil arrangement 30 can be conveniently located in the air return duct upstream from the heat exchanger 10.

Figure 2:
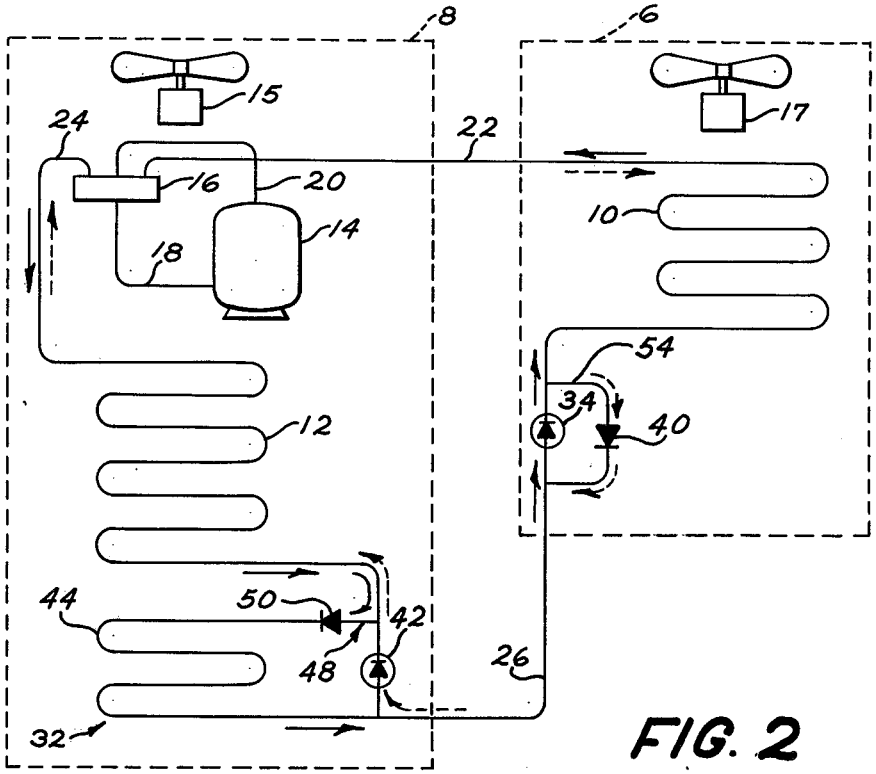
FIG. 2 is a schematic diagram of another embodiment of a heat pump with the auxiliary coil arrangement of this invention applied to only the outdoor heat exchanger.

Referring now to FIG. 2, there is shown the auxiliary coil arrangement 32 including subcooling coil 44 and check valve 50 positioned in the air flow upstream relative to the outdoor heat exchanger 12. In this application, the subcooling feature and liquid refrigerant storage is applied to the outdoor unit 8 and heat exchanger 12, as explained hereinabove, while the indoor section 6 is furnished with the customary expansion device 34 that allows a regulated flow of refrigerant in the cooling cycle, and a by-pass conduit 54 with check valve 40 for allowing unrestricted flow in the heating cycle.

Figure 3:
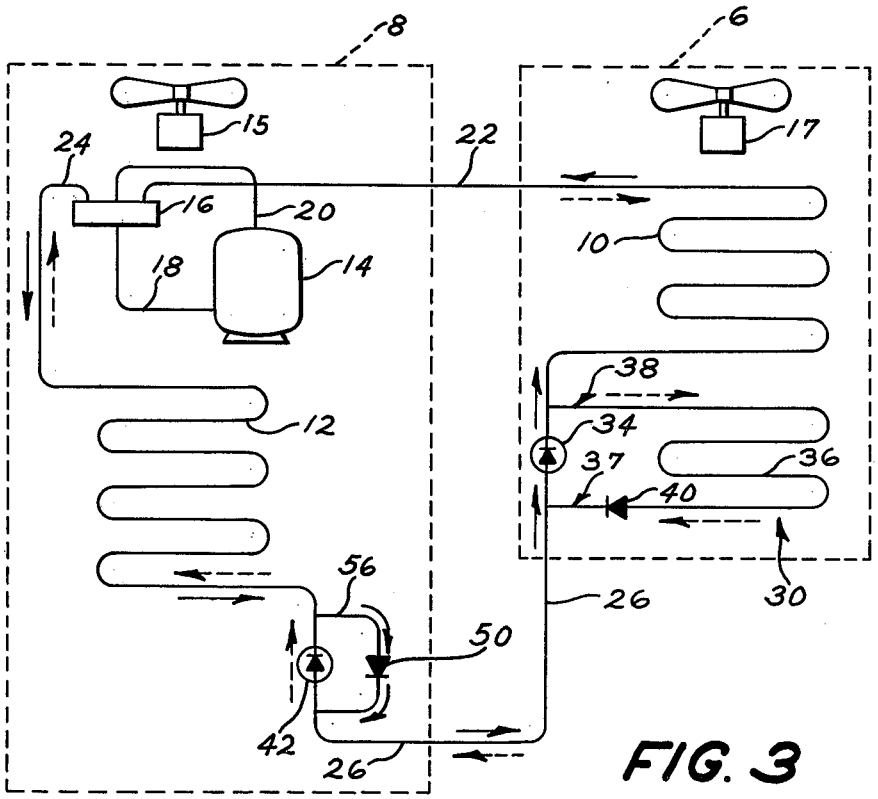
FIG. 3 is a schematic diagram of still another embodiment of a heat pump with the auxiliary coil arrangement of this invention applied to only the indoor heat exchanger.

In the embodiment shown in FIG. 3, the auxiliary coil arrangement 30 including subcooling coil 36 and check valve 40 is positioned in the air flow upstream relative to the indoor heat exchanger 10. In this application, the subcooling feature is applied to the indoor unit 6 and heat exchanger 10, as explained hereinabove, while the outdoor section 8 is furnished with the customary expansion device 42 that allows a regulated flow of refrigerant in the heating cycle, and by-pass conduit 56 and check valve 50 for allowing unrestricted flow in the cooling cycle.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. In a refrigeration heat pump system of the type including a compressor; a fluid reversal means for switching said system between a cooling and heating mode; an indoor heat exchanger; a first flow conduit connecting said reversal means to one end of said indoor heat exchanger; an outdoor heat exchanger; a second flow conduit connecting said reversal means to one end of said outdoor heat exchanger; a liquid line conduit connecting the other ends of said heat exchangers; first expansion means in flow arrangement intermediate said liquid line conduit and said outdoor heat exchanger for permitting refrigerant flow only in the direction toward said outdoor heat exchanger, and second expansion means in flow arrangement intermediate said liquid line conduit and said indoor heat exchanger for regulating refrigerant flow to said indoor heat exchanger; means for conducting refrigerant in a first closed circuit path when said heat pump is operating in said cooling mode from said compressor through said reversal means to said outdoor heat exchanger, said liquid line, and then through said second refrigerant expansion means to said indoor heat exchanger and back to said compressor; said reversal means being adapted to be repositioned to place said system in the heating mode to allow refrigerant from said compressor to flow in a second closed circuit path to said indoor heat exchanger, through said liquid line and then through said first refrigerant expansion means to said outdoor heat exchanger and then back to said compressor, means for increasing the capacity of the heat pump system, comprising:

an auxiliary coil arranged in the path of air passing over said outdoor heat exchanger, flow means having a first portion connecting one end of said auxiliary coil in said system between said first expansion means, and the other end of said outdoor heat exchanger, and a second portion connecting the other end of said auxiliary coil to said liquid line so that said auxiliary coil is in parallel flow arrangement with said first expansion means;

valve means in said first portion of said auxiliary coil flow means responsive to the direction of refrigerant flow for permitting refrigerant flow only in one direction so that in said cooling mode refrigerant flow from said outdoor heat exchanger that is blocked from by-passing said auxiliary coil by said first expansion means flows through said auxiliary coil to said liquid line to provide subcooling of liquid refrigerant, and in said heating mode refrigerant is permitted to flow from said liquid line through said first expansion means and said indoor heat exchanger with a portion of said refrigerant flowing from said liquid line through the second portion of said auxiliary coil flow means into said auxiliary coil with said portion of refrigerant being blocked from flowing therethrough by said valve means, thereby causing said portion of liquid refrigerant to be stored in said auxiliary coil.

2. The heat pump system of claim 1 wherein said valve means in said auxiliary flow means is arranged between said liquid line conduit at a point intermediate said first expansion means and said outdoor heat exchangers, said expansion means including means responsive to the direction of refrigerant flow.

3. The heat pump system of claim 2 wherein said valve means includes means operable to an open position by refrigerant flow in the cooling mode only.

4. The heat pump system of claim 3 wherein a by-pass means is arranged parallel with said second expansion means to provide unrestricted flow of refrigerant to said first expansion means in said heating mode.

5. In a refrigeration heat pump system of the type including a compressor; a fluid reversal means for switching said system between a cooling and heating mode; an indoor heat exchanger; a first flow conduit connecting said reversal means to one end of said indoor heat exchanger; an outdoor heat exchanger; a second flow conduit connecting said reversal means to one end of said outdoor heat exchanger; a liquid line conduit connecting the other ends of said heat exchangers; first expansion means in flow arrangement intermediate said liquid line conduit and said outdoor heat exchanger for regulating refrigeration flow to said outdoor heat exchanger, and second expansion means in flow arrangement intermediate said liquid line conduit and said indoor heat exchanger for regulating refrigerant flow only in the direction toward said indoor heat exchanger; means for conducting refrigerant in a first closed circuit path when said heat pump is operating in said cooling mode from said compressor through said reversal means to said outdoor heat exchanger, said liquid line, and then through said second refrigerant expansion means to said indoor heat exchanger and back to said compressor; said reversal means being adapted to be repositioned to place said system in the heating mode to allow refrigerant from said compressor to flow in a second closed circuit path to said indoor heat exchanger, said liquid line, and then through said first refrigerant expansion means to said outdoor heat exchanger and then back to said compressor, means for increasing the capacity of the heat pump system, comprising:

an auxiliary coil arranged in the path of air passing over said indoor heat exchanger, flow means having a first portion connecting one end of said auxiliary coil in said system between said second expansion means and the other end of said indoor heat exchanger and a second portion connecting the other end of said auxiliary coil to said liquid line so that said auxiliary coil is in parallel flow arrangement with said second expansion means;

valve means in said second portion of said auxiliary flow means responsive to the direction of refrigerant flow for permitting refrigerant flow only in one direction so that in said heating mode refrigerant flow from said indoor heat exchanger that is blocked from by-passing said auxiliary coil by said second expansion means flows through said auxiliary coil to said liquid line to provide subcooling of liquid refrigerant, and in said cooling mode refrigerant is permitted to flow from said liquid line through said second expansion means and said indoor heat exchanger with a portion of said refrigerant passing through said second expansion means flowing through said first portion of auxiliary flow means into said auxiliary coil with said portion of refrigerant being blocked from flowing therethrough by said valve means, thereby causing said portion of gaseous refrigerant to be stored in said auxiliary coil.

6. The heat pump system of claim 5 wherein said valve means in said auxiliary flow means is arranged between said liquid line conduit at a point intermediate said second expansion means and said auxiliary coil, said expansion means including means responsive to the direction of refrigerant flow.

7. The heat pump system of claim 5 wherein said valve means includes means operable to an open position by refrigerant flow in the heating mode only.

8. The heat pump system of claim 5 wherein a by-pass means is arranged parallel with said first expansion means to provide unrestricted flow of refrigerant to said second expansion means in said cooling mode.

9. In a refrigeration heat pump system of the type including a compressor; a fluid reversal means for switching said system between a cooling and heating mode; an indoor heat exchanger; a first flow conduit connecting said reversal means to one end of said indoor heat exchanger; an outdoor heat exchanger; a second flow conduit connecting said reversal means to one end of said outdoor heat exchanger; a liquid line conduit connecting the other end of said heat exchangers; first expansion means in flow arrangement intermediate said liquid line conduit and said outdoor heat exchanger for permitting refrigeration flow only in the direction toward said outdoor heat exchanger, and second expansion means in flow arrangement intermediate said liquid line conduit and said indoor heat exchanger for permitting refrigerant flow only in the direction toward said indoor heat exchanger; means for conducting refrigerant in a first closed circuit path when said heat pump is operating in said cooling mode from said compressor through said reversal means to said outdoor heat exchanger, said liquid line, and then through said second refrigerant expansion means to said indoor heat exchanger and back to said compressor; said reversal means being adapted to be repositioned to place said system in the heating mode to allow refrigerant from said compressor to flow in a second closed circuit path to said indoor heat exchanger, said liquid line, and then through said first refrigerant expansion means to said outdoor heat exchanger and then back to said compressor, means for increasing the capacity of the heat pump system, comprising:

an auxiliary coil arranged in the path of air passing over said outdoor heat exchanger, flow means having a first portion connecting one end of said auxiliary coil in said system between said first expansion means, and the other end of said outdoor heat exchanger, and a second portion connecting the other end of said auxiliary coil to said liquid line so that said auxiliary coil is in parallel flow arrangement with said first expansion means;

valve means in said first portion of said auxiliary coil flow means responsive to the direction of refrigerant flow for permitting refrigerant flow only in one direction so that in said cooling mode refrigerant flow from said outdoor heat exchanger that is blocked from by-passing said auxiliary coil by said first expansion means flow through said auxiliary coil to said liquid line to provide subcooling of liquid refrigerant, and in said heating mode refrigerant is permitted to flow from said liquid line through said first expansion means and said outdoor heat exchanger with a portion of said refrigerant flowing from said liquid line through the second portion of said auxiliary coil flow means into said auxiliary coil with said portion of refrigerant being blocked from flowing therethrough by said valve means, thereby causing said portion of liquid refrigerant to be stored in said auxiliary coil;

an auxiliary coil arranged in the path of air passing over said indoor heat exchanger, flow means having a first portion connecting one end of said auxiliary coil in said system between said second expansion means and the other end of said indoor heat exchanger and a second portion connecting the other end of said auxiliary coil to said liquid line so that said auxiliary coil is in parallel flow arrangement with said second expansion means;

valve means in said second portion of said auxiliary flow means responsive to the direction of refrigerant flow for permitting refrigerant flow only in one direction so that in said heating mode refrigerant flow from said indoor heat exchanger that is blocked from by-passing said auxiliary coil by said second expansion means flows through said auxiliary coil to said liquid line to provide subcooling of liquid refrigerant, and in said cooling mode refrigerant is permitted to flow from said liquid line through said second expansion means and said indoor heat exchanger with a portion of said refrigerant passing through said second expansion means flowing through said first portion of auxiliary flow means into said auxiliary coil with said portion of refrigerant being blocked from flowing therethrough by said valve means, thereby causing said portion of gaseous refrigerant to be stored in said auxiliary coil.

10. The heat pump system of claim 9 wherein said valve means in said first auxiliary flow means is arranged between said liquid line conduit at a point intermediate said first expansion means and said outdoor heat exchangers, said expansion means including means responsive to the direction of refrigerant flow.

11. The heat pump system of claim 10 wherein said first valve means includes means operable to an open position by refrigerant flow in the cooling mode only.

12. The heat pump system of claim 9 wherein said second valve means in said second auxiliary flow means is arranged between said liquid line conduit at a point intermediate said second expansion means and said indoor heat exchanger, said expansion means including means responsive to the direction of refrigerant flow.

13. The heat pump system of claim 12 wherein said second valve means includes means operable to an open position by refrigerant flow in the heating mode only.

* * * * *